US005707024A

United States Patent [19]

Mellquist et al.

[11] Patent Number: 5,707,024

[45] Date of Patent: Jan. 13, 1998

[54] METHOD AND AN APPARATUS FOR THE PARALLEL DISPLACEMENT OF A MATERIAL WEB

[75] Inventors: Henrik Mellquist, Göteborg; Rolf Thulin, Staffanstorp; Hans Nantin, Trelleborg, all of Sweden

[73] Assignee: Tetra Laval Holdings & Finance S.A., Pully, Switzerland

[21] Appl. No.: 584,552

[22] Filed: Jan. 11, 1996

[30] Foreign Application Priority Data

Jan. 11, 1995 [SE] Sweden ..... 9500077

[51] Int. Cl.[6] ..... B65H 19/14

[52] U.S. Cl. ..... 242/418.1; 242/552; 242/554.1; 226/113

[58] Field of Search ..... 242/418.1, 552, 242/554.1, 555.4, 560.1, 563; 226/43

[56] References Cited

U.S. PATENT DOCUMENTS

| | | | |
|---|---|---|---|
| 2,147,467 | 2/1939 | Stephenson . | |
| 3,721,376 | 3/1973 | Christian et al. | 226/113 |
| 4,386,988 | 6/1983 | Kontz . | |
| 4,561,581 | 12/1985 | Kelly | 226/113 |
| 4,589,605 | 5/1986 | Orii . | |
| 4,611,799 | 9/1986 | Nuttin | 242/418.1 |
| 5,284,197 | 2/1994 | Cederholm et al. | 242/554.1 |

FOREIGN PATENT DOCUMENTS

| | | | |
|---|---|---|---|
| 468068 | 9/1950 | Canada | 242/418.1 |
| 61-166453 | 7/1986 | Japan | 242/418.1 |
| 3-162368 | 7/1991 | Japan | 242/418.1 |
| 3-216448 | 9/1991 | Japan | 242/418.1 |
| 956403 | 9/1982 | U.S.S.R. | 242/418.1 |

*Primary Examiner*—John P. Darling
*Attorney, Agent, or Firm*—Burns, Doane, Swecker & Mathis, L.L.P.

[57] ABSTRACT

A method and an apparatus for the parallel displacement of a material web (1) are disclosed, in that the material web (1) is, between two driven bending rollers (6,8), caused to form a freely depending bight or loop (11) whose lower end is read-off by a sensing device (12). The sensing device (12) controls the speed of the first bending roller (6), while the second bending roller (8) is driven at constant speed.

10 Claims, 4 Drawing Sheets

METHOD AND AN APPARATUS FOR THE PARALLEL DISPLACEMENT OF A MATERIAL WEB

TECHNICAL FIELD

The present invention relates to a method and an apparatus for the parallel displacement of a material web by advancing the material web over a first, driven bending roller and a second, driven bending roller which is offset in parallel in relation to the first bending roller.

BACKGROUND ART

When a material web, for example in a filling machine for the filling and production of packages of the single use disposable type, is to be spliced or joined to another web, the intention is to be able to carry out the splicing operation as rapidly as possible without stopping production and without the material storage reels taking up excessive space.

The material web which is employed for the filling machines intended for the packing of liquid foods into, for example, parallelepipedic packages, in which the material web is formed, filled and severed to form individual packages consists of paper board or paper to which different plastic layers are laminated, and, on occasions, also aluminium foil. This packaging material web is relatively rigid and unwieldy in handling.

In the splicing operation in machines in operation today, use is made of so-called storage reels placed after one another, in which operation the splicing is carried out from the one reel to the other and the incoming spliced reel is thereafter moved to an inner production output position. As an alternative, the reels are placed beside one another, in which event that reel which is currently being used is placed centrally, so that the material web runs directly and exactly into the filling machine. Also in this case, the incoming spliced storage, or jumbo, reel must be moved into this central position after the splicing operation.

OBJECT OF THE INVENTION

One object of the present invention is to realise a method for the parallel displacement of the material web so that the storage reels need not be moved to a central position after the splicing operation, but instead that the splicing operation may be carried out rapidly and easily during production, and the space required for storage reels may be rendered as compact and slight as possible.

SOLUTION

This and other objects have been attained according to the present invention in that the method described by way of introduction has been given the characterizing feature that the material web, between the two bending rollers, is caused to form a freely depending bight or loop whose lower position is read-off by a sensing device which controls the operation of the one bending roller.

Preferred embodiments of the present invention have further been given the characterizing features as set forth in the appended subclaims.

BRIEF DESCRIPTION OF THE ACCOMPANYING DRAWINGS

One preferred embodiment of the present invention will now be described in greater detail hereinbelow, with particular reference to the accompanying Drawings, in which.

Figure 1:
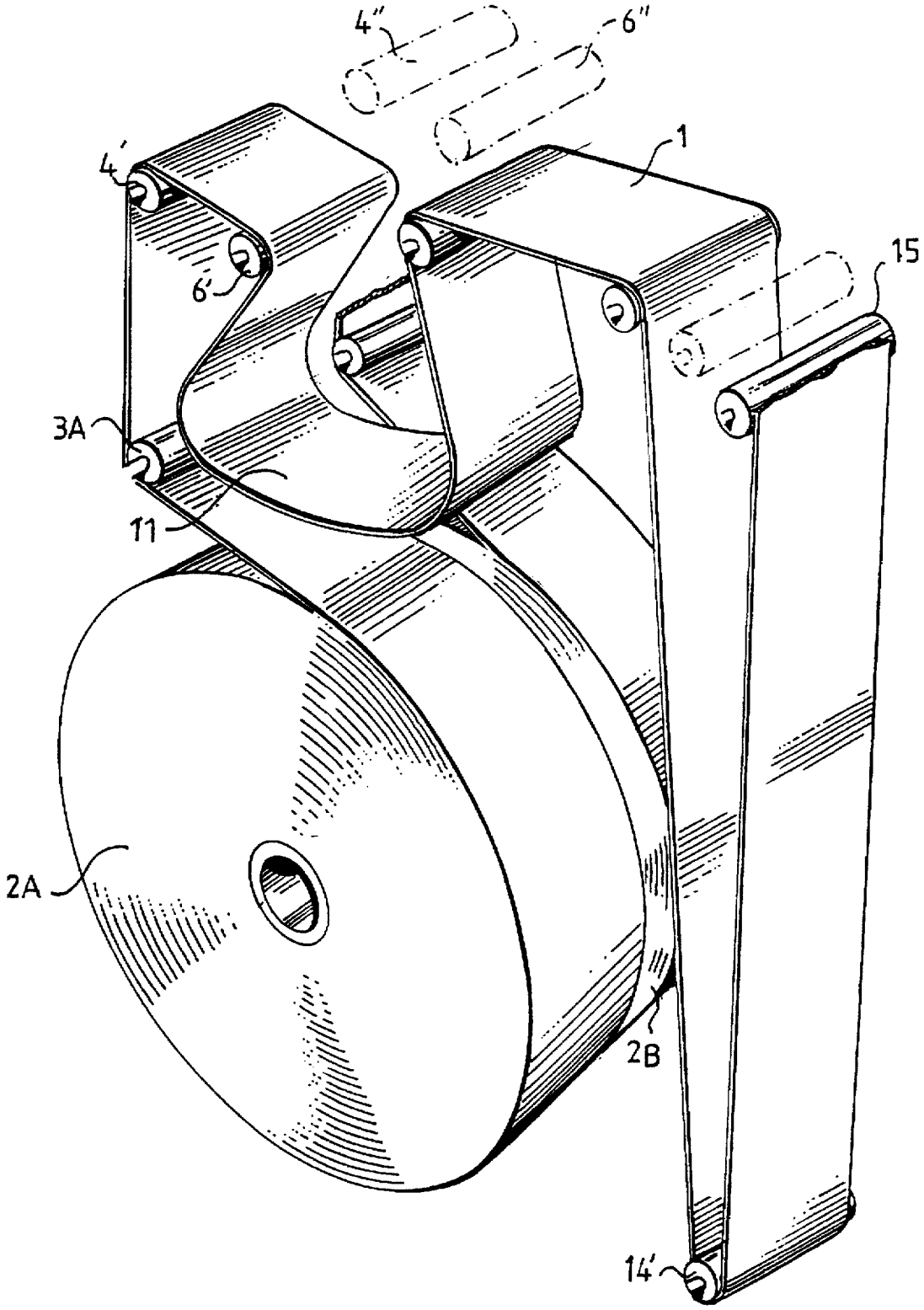
FIG. 1 shows the parallel displacement of the material web from the one lateral position.

The accompanying Drawings show only those details essential to an understanding of the present invention, and consequently the location of the storage reels in the filling machine and the drawing of the material web have been omitted from this presentation as being well-known to a person skilled in the art.

DESCRIPTION OF PREFERRED EMBODIMENT

The method according to the invention for the parallel displacement of a material web 1 is intended to be employed in the splicing of a material web 1 from one storage reel 2 A to a new storage reel 2 B. In the types of filling machines in which the method according to the invention is intended to be used, the machine is provided with a large storage reel 2 in a space intended therefore, from whence the material web 1 runs through the machine and is processed, sealed, filled and severed to form individual packages.

Figure 2:
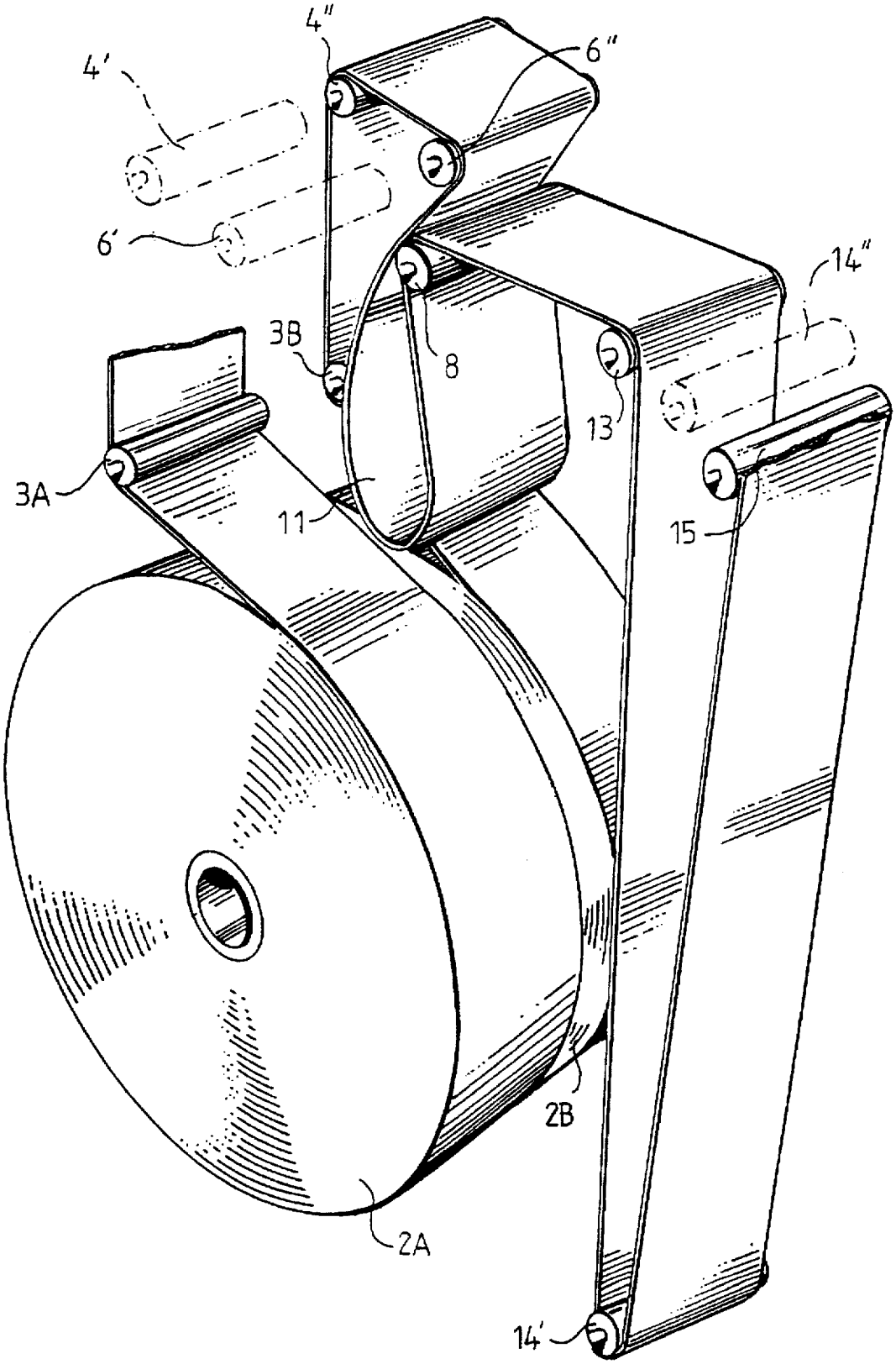
FIG. 2 shows the parallel displacement of the material web from the other lateral position.

As shown in FIGS. 1 and 2, two storage reels 2 are placed side-by-side in a reel magazine intended therefore, which may be made relatively narrow and compact since the reels 2 are not intended to be moved laterally or moved in any other way, after being housed in the magazine.

The material web 1 preferably consists of paper or paper board to which different thermoplastic layers, and possibly also aluminium, have been laminated.

In the preferred embodiment, both of the storage reels 2 are placed symmetrically on either side of the centre line of the filling machine. FIG. 1 shows the case in which the one storage reel 2 A is employed, and FIG. 2 shows the case in which the second storage reel 2 B is in use. In continuous production, use is made of one or the other position alternatingly, according as splicing is necessary, so as to maintain the continuous production output of packages. The storage reels 2 need not be symmetrically placed, but may be at different distances from the centre line of the machine, or alternatively the first reel 2 may be placed in the centre line and the second reel 2 is laterally offset in relation to the first reel.

Figure 3:
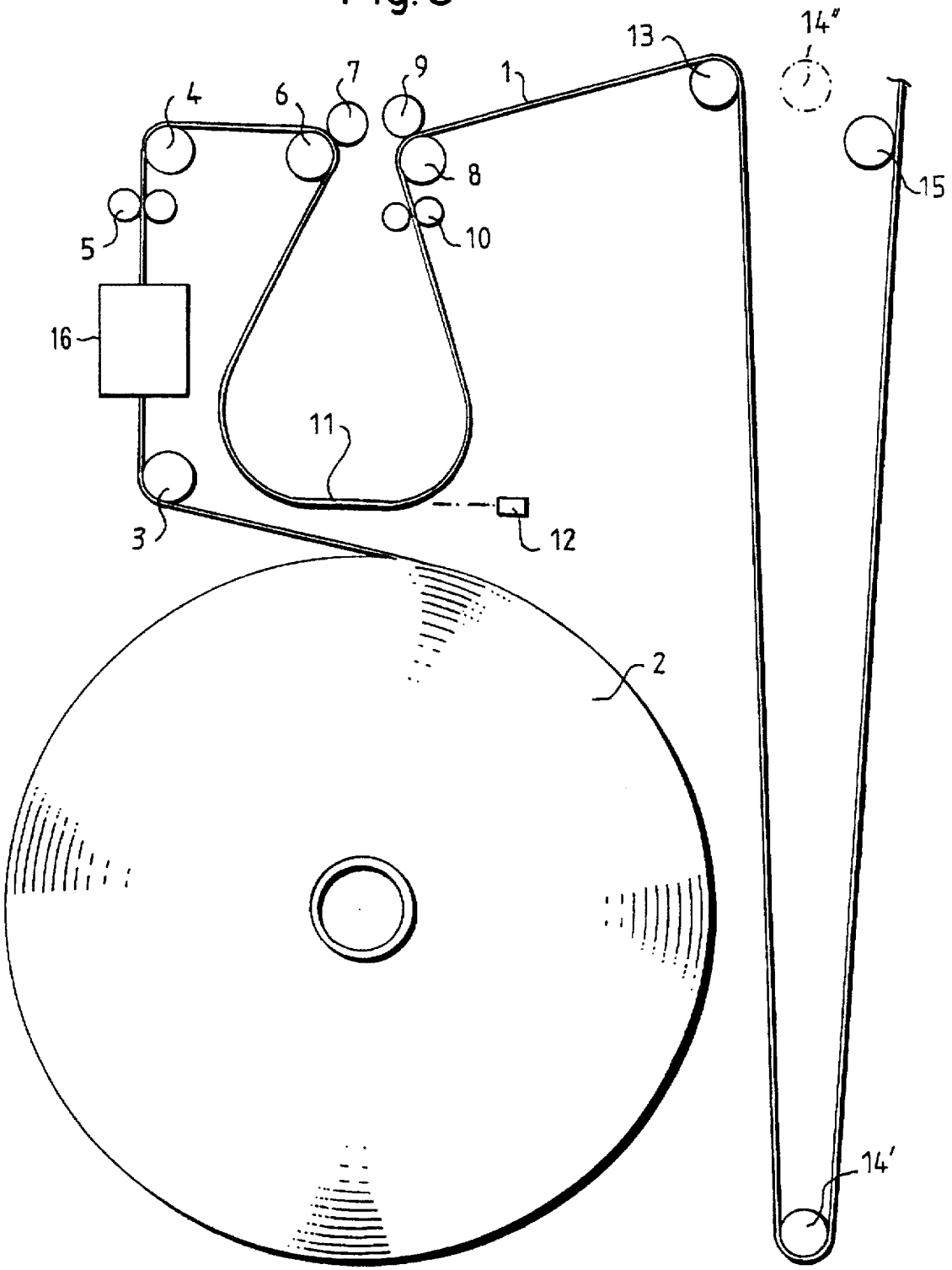
FIG. 3 is a side elevation with a virgin storage reel.
Figure 4:
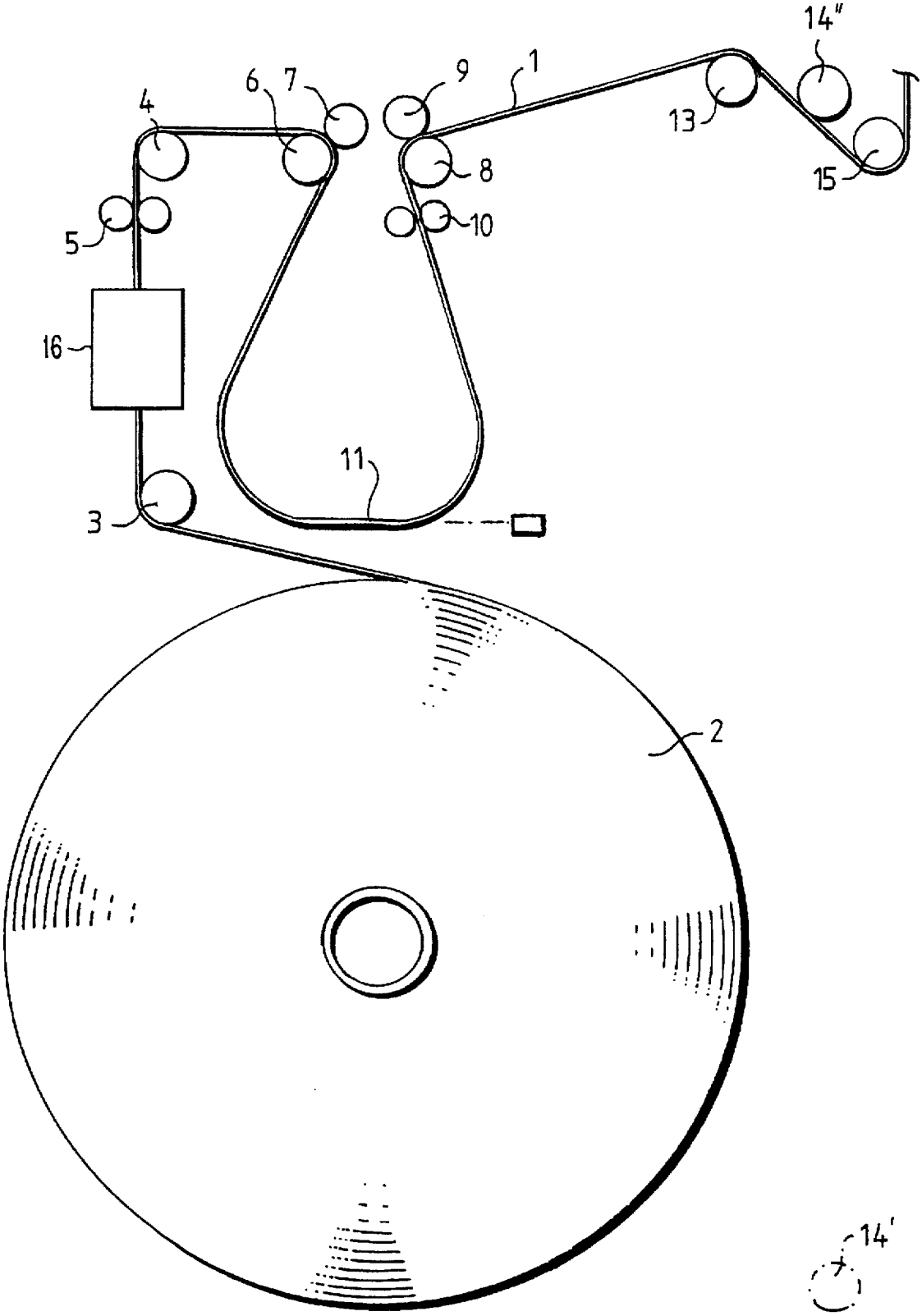
FIG. 4 is a side elevation showing a used storage reel.

The splicing equipment 16 which should be available for machine staff, is suitably placed between one roller 3 and a second roller 4. After the splicing equipment 16, some form of edge guide 5 may be placed in the path of advancement of the material web 1, as shown in FIGS. 3 and 4.

After the two rollers 3 and 4, there is disposed a first bending roller 6 which is driven and has an idling roller 7 resting against it. Alternatively, the idling roller 7 may be driven and the bending roller 6 may run freely against the roller 7. For reducing the method according to the present invention into practice, there is also required a second bending roller 8 (which is also driven), with a corresponding idling roller 9. This second bending roller 8 is offset in parallel in relation to the first bending roller 6, and the second bending roller 8 is located in the centre line of the filling machine. After the parallel displacement, i.e. at the second bending roller 8, some form of edge guide 10 is suitably once again placed in position.

In the path of the material web 1, there is also suitably disposed some form of magazine for creating the requisite time for the splicing operation, without the need for stopping the machine.

As shown in FIG. 2, the use of the second storage reel 2 B corresponds to the above-described equipment. Between the first two rollers 3 B, 4", there is a splicing apparatus 16 (not illustrated in FIGS. 1 and 2), and thereafter a first bending roller 6". The centrally placed second bending roller 8 consists of the same bending roller 8 as in the case illustrated in FIG. 1.

As an alternative to the case where both of the rollers 3 and 4, the splicing apparatus 16 and the first bending roller 6 are wholly or partly separate, on either side of the web 1, these parts 1 may be common and laterally movable to one or the other side as required.

Thus, the material web 1 arrives from one or the other side of the centre line and is spliced into a central material drawing situation.

The material web 1 is passed from one of the storage reels 2 over a roller 3 past the splicing apparatus 16 over a further roller 4 and reaches the first bending roller 6. Thereafter, the material web 1 is caused to form a freely depending loop or bight 11 between the two bending rollers 6 and 8. The material loop 11 thus constitutes the vertical parallel displacement of the material web 1 when the first bending roller 6 is placed on one side of the centre line of the filling machine and the second bending roller 8 is placed in the centre line. The length of the material loop or bight 11 is selected to be as short as possible without the material web 1 being damaged or twisted in a manner that might impair further handling of the web. It generally applies according to the invention that the further the distance from a storage reel 2 to the centre line of the filling machine, the longer the loop 11 must be.

The first bending roller 6 is driven at varying speed, this being governed by means of a sensing device 12 placed at and disposed to read-off the lower position of the material loop. The sensing device 12 suitably consists of a photocell or the like. When the photocell 12 is covered, i.e. it "sees" the material loop 11, the speed of the first bending roller 6 is reduced and, when the photocell 12 is free, i.e. it "does not see" the material loop 11, the speed of the first bending roller 6 is increased. The second bending roller 8 is driven at a constant speed which is slower than the higher speed of the first bending roller 6. Alternatively, the first bending roller 6 is driven at constant speed while the second bending roller 8 operates at varying speed. It is also possible to employ two photocells 12 which, in the two positions, either stop or start operation, alternatively, of one of the two bending rollers 6, 8; while the second bending roller 6, 8 is driven at constant speed.

The material web 1 is thereafter led in its new central position through the filling machine across a new roller 13. Other work stations may be provided between the two latter rollers 8 and 13, such as strip applicators, pull-tab applicators, etc. Alternatively, this latter roller 13 may be driven instead of the second bending roller 8.

When the method according to the present invention is employed for splicing to a filling machine, use is suitably also made of some form of magazine in which a magazine reel 14 may pivot vertically between two rollers 13 and 15. FIGS. 3 and 4 show these two positions, in which FIG. 3 shows a full but unused magazine, with the magazine reel 14 in its lower extreme position. FIG. 4 shows an empty and completely used magazine, with the magazine reel 14 in its upper extreme position. The time that elapses for the magazine reel 14 to move from the one extreme position to the other, i.e. from completely full to completely empty magazine, allows the requisite time for splicing so that the filling machine can be driven continuously without needing to be stopped for the splicing operation.

As will have been apparent from the foregoing description, the present invention realises the possibility of parallel displacement of the material web so that the storage reels may be retained in their initial positions and a space will be created for storage reels which takes up the smallest possible space.

The present invention should not be considered as restricted to that described above and shown on the Drawings, many modifications being conceivable without departing from the and scope of the appended claims.

What is claimed is:

1. A method of parallel displacement of a material web, by advancing the material web past a splicing apparatus, over a first, driven bending roller, and over a second, driven bending roller, which is offset in parallel in relation to the first bending roller, comprising causing the material web to form a freely depending bight or loop in the path of material advancement downstream of said splicing apparatus whose lower position is read-off by a sensing device which controls the driving of one of the first and second bending rollers.

2. The method of parallel displacement of a material web as claimed in claim 1, wherein the sensing device comprises a photocell.

3. The method as claimed in claim 1, wherein the sensing device controls the driving of the first bending roller so that the bending roller is driven at a lower speed when the material loop covers the sensing device.

4. The method as claimed in claim 3, wherein the first bending roller is driven at a higher speed when the sensing device is not covered by the material loop.

5. The method as claimed in claim 4, wherein the speed of the second bending roller is constant and is slower than the high speed of the first bending roller.

6. An apparatus for parallel displacement of a material web, comprising a storage reel, a first driven bending roller, a second driven bending roller offset in parallel in relation to the first bending roller and to the storage reel such that the material web is disposed between the first and second drive rollers to create a freely depending bight or loop, a sensing device which is disposed to control the speed of one of the bending rollers, and a splicing apparatus positioned between said storage reel and said first driven bending roller to splice said material web from said storage reel.

7. An apparatus for parallel displacement of a material web, comprising:

a first roller;

a second roller offset in parallel relative to said first roller to create a freely depending bight when a material web is disposed between said first and second rollers;

a sensing device positioned to sense a position of said bight, said sensing device generating a signal usable to control the speed of one of said first and second rollers; and a splicing apparatus positioned upstream of said first roller, said splicing apparatus capable of splicing a material web moving toward said first roller from a first storage reel upstream of said splicing apparatus to a material web from a second storage reel upstream of said splicing apparatus and offset parallel to said first storage reel.

8. An apparatus according to claim 7, further comprising a magazine reel downstream of said second roller and movable between a first, full, unused position and a second, empty, used position, wherein when a material web is moving past said magazine reel and said magazine reel moves from said first position to said second position, an amount of material web is fed downstream of said magazine reel to allow said splicing apparatus to splice said material web.

9. A method of controlling the parallel displacement of a material web in an apparatus that advances the material web from a first storage reel, past a splicing apparatus, over a first roller, and over second roller which is offset relative to the first roller, comprising the steps of:

forming a bight in the material web between the two rollers and in the path of material advancement downstream of said splicing apparatus;

determining whether said bight extends to at least a lower position; and controlling the driving of one of said first and second rollers based upon the result of said determining step.

10. A method according to claim 9, further comprising the steps:

feeding a length of material web downstream of a magazine reel by moving said magazine reel from a first, full, unused position to a second, empty, used position; and splicing said material web from said first storage reel to a material web from a second storage reel, said length of material web sufficient to allow said splicing without stopping any apparatus downstream of said magazine reel.

* * * * *